US005341960A

United States Patent [19]

Lay

[11] Patent Number: 5,341,960

[45] Date of Patent: Aug. 30, 1994

[54] TOGGLE-ACTION DISPENSING CLOSURE WITH CAPTURE STRUCTURE FOR SEVERABLE ACTUATION-PREVENTION ABUTMENT

[75] Inventor: Dieter Lay, Oconomowoc, Wis.

[73] Assignee: AptarGroup, Inc., Crystal Lake, Ill.

[21] Appl. No.: 169,514

[22] Filed: Dec. 17, 1993

[51] Int. Cl.[5] ..... B67D 5/32

[52] U.S. Cl. ..... 222/153; 222/536

[58] Field of Search ..... 222/153, 534, 536, 556

[56] References Cited

U.S. PATENT DOCUMENTS

| | | | |
|---|---|---|---|
| 3,223,287 | 12/1965 | Sagarin | 222/153 |
| 3,568,895 | 3/1971 | Porter | 222/534 |
| 4,095,725 | 6/1978 | Goxglues | 222/153 |
| 4,452,364 | 6/1984 | Kay | 215/253 |
| 4,607,768 | 8/1986 | Taber et al. | 222/556 |
| 4,610,371 | 9/1986 | Karkiewicz | 220/266 |
| 4,711,372 | 12/1987 | Guch | 222/23 |
| 4,776,501 | 10/1988 | Ostrowsky | 222/536 |
| 4,805,792 | 2/1989 | Lecinski, Jr. | 215/253 |
| 4,962,869 | 10/1990 | Gross et al. | 222/153 |
| 5,152,432 | 10/1992 | De Laforcade | 222/145 |

*Primary Examiner*—Andres Kashnikow
*Assistant Examiner*—Philippe Derakshani
*Attorney, Agent, or Firm*—Dressler, Goldsmith, Shore & Milnamow, Ltd.

[57] ABSTRACT

A toggle-action container dispensing closure is provided for manipulation between a closed, non-dispensing orientation and an open, dispensing orientation. The closure includes an actuator mounted on a body secured to the container. The actuator is tiltable between a closed position and an open position. The body has a severable abutment portion under the actuator. The actuator has a shearing wall confronting the abutment. The actuator includes a depending structure defining a pair of spaced-apart retaining surfaces for sliding into engagement with the abutment when the actuator is subjected to at least a predetermined force to shear the abutment whereby the sheared off abutment is gripped between the retaining surfaces.

12 Claims, 2 Drawing Sheets

TOGGLE-ACTION DISPENSING CLOSURE WITH CAPTURE STRUCTURE FOR SEVERABLE ACTUATION-PREVENTION ABUTMENT

TECHNICAL FIELD

This invention relates to a container toggle-action dispensing closure which can be manipulated between a closed orientation and an open, dispensing orientation.

BACKGROUND OF THE INVENTION AND TECHNICAL PROBLEMS POSED BY THE PRIOR ART

Designs have been proposed for containers used with flowable substances wherein a closure is provided for being attached to the container mouth and wherein the closure includes a toggle-action actuator, flip-up spout, or nozzle assembly for dispensing the container contents. See, for example, U.S. Pat. Nos. 5,058,775 4,962,869, 4,776,501, 4,645,086 and 3,516,581.

The toggle-action closures, such as those disclosed in the above-referenced U.S. Pat. Nos. 5,058,775, 4,962,869, and 4,776,501, require that the operator push down on a top, rear portion of the closure in order to pivot the actuator of the closure to the dispensing orientation.

When the actuator is pivoted to the dispensing position, a discharge passage in the actuator is in communication with the container contents, and the container contents can flow out through the actuator. Typically, such toggle-action closures are provided on squeezable containers fabricated from a thermoplastic material providing a inwardly deformable, resilient wall structure. When the container wall structure is squeezed, the contents within the container are forced upwardly and out through the open dispensing closure.

During shipping and handling, a toggle-action closure may be accidentally bumped or impacted in a way that causes the closure to pivot to the dispensing orientation. It is then possible for the contents to be discharged. If the container is lying on its side, the contents can leak out of the accidentally opened closure. If the container is in a carton, the carton may be subjected to rough handling causing the wall of the container to be temporarily squeezed inwardly and causing an unwanted discharge of a portion of the container contents through the open closure.

In order to prevent or substantially minimize the potential for leakage or spillage of container contents during shipping and handling of containers provided with toggle-action closures, the closure of the type disclosed in the above-referenced U.S. Pat. No. 4,962,869 was developed. This closure has effectively solved a long-felt need to prevent inadvertent discharge through toggle-action closures during shipping and handling.

The closure disclosed in the U.S. Pat. No. 4,962,869 provides a unique structure which prevents or greatly inhibits the opening of the toggle-action actuator during shipping and handling. In particular, the closure body is provided with an upstanding abutment or resistance post under a rear portion of the toggle-action actuator. The actuator includes a shearing wall for confronting the abutment post when the actuator is initially closed in the non-dispensing position. When a moderate force is applied to the rear of the actuator, the actuator will not tilt upwardly to the open position because the shearing wall engages the abutment.

The abutment is designed to withstand the forces typically encountered during shipping and handling. However, the abutment is designed to be sheared off when the actuator is subjected to at least a predetermined force greater than the forces typically encountered during shipping and handling. When the consumer uses the closure for the first time, the consumer must apply, to the rear of the actuator, a force at least equal to the predetermined force so as to cause the shearing wall to shear off the abutment. Thereafter, the consumer can subsequently open the actuator by applying a much lower force.

The above-discussed design disclosed in the U.S. Pat. No. 4,962,869 functions very well and satisfies the objectives of preventing or inhibiting leakage during shipping and handling. However, when the consumer initially applies the greater force to shear off the abutment, the sheared off abutment remains loose in the space between the underside of the actuator and the closure body in which the actuator is pivotally mounted.

The sheared-off abutment may roll and slide around underneath the actuator. This may inhibit subsequent proper opening of the actuator. In any event, the movement of the loose piece within the closure may be disconcerting to the consumer. The consumer may think that there is something wrong with the closure or may be otherwise bothered by the occasional movement of the sheared-off abutment during use of the closure. In view of this, it would be desirable to provide an improved dispensing closure with an actuation-prevention abutment that would not remain loose in the closure after being sheared off.

Further, it would be advantageous if such an improved closure could be incorporated in existing closures with a minimum of design changes.

Additionally, it would be desirable if such an improved closure could be incorporated in a design having an aesthetically pleasing exterior configuration substantially free of functional details and outwardly projecting features.

It would also be advantageous if such an improved design could be easily incorporated in existing molds and be easily molded.

The present invention provides an improved closure which can accommodate designs having the above-discussed benefits and features.

SUMMARY OF THE INVENTION

The present invention provides a novel, toggle-action dispensing closure which can have a contemporary, clean design with virtually all features contained within an aesthetically pleasing profile and with virtually no visible functional details.

The closure is adapted to be mounted over the opening in a container, especially a container of the type having a generally flexible wall portion which can be squeezed to assist in dispensing the contents from the container.

The closure includes a severable abutment for preventing, or reducing the likelihood of, an inadvertent, premature opening or actuation of the closure to the dispensing position during shipping and handling.

When the closure is first used by the consumer, the abutment is sheared off, but is retained in a structure so that it is prevented from moving or rattling within the closure. The closure components can be relatively easily manufactured and readily assembled.

The closure includes a body for engaging the container over the opening to the container. The body defines a discharge aperture communicating with the container opening.

An actuator is pivotally mounted on the body for occluding flow from the container through the discharge aperture when the actuator is in a closed, non-dispensing position. The actuator permits flow from the container when force is applied to the actuator to tilt the actuator to an open, dispensing position.

The body has a severable abutment portion under the actuator. The actuator has a shearing wall for confronting the abutment when the actuator is in the non-dispensing position. This prevents the tilting of the actuator to the dispensing position in response to the actuator being subjected to a force less than a predetermined force. However, the shearing wall shears the abutment portion from the body when the actuator is subjected to at least the predetermined force so that thereafter, the actuator can be tilted to the dispensing position in response to the application of a force less than the predetermined force.

The actuator has a structure that defines a pair of spaced-apart retaining surfaces. The retaining surfaces can slide into engagement with the abutment when the actuator is subjected to at least the predetermined force as the actuator is tilted to the open dispensing position. Then, as the abutment is sheared off by the shearing wall, the abutment is gripped between the retaining surfaces. The sheared off abutment remains gripped between the retaining surfaces throughout all subsequent operations of the closure. Thus, the sheared off abutment cannot roll or rattle around within the closure or lodge under the actuator in a way that inhibits subsequent operation.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DESCRIPTION OF THE PREFERRED EMBODIMENT

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the closure of this invention is described in an upright position, and terms such as upper, lower, horizontal, etc., are used with reference to this position. It will be understood, however, that the closure of this invention may be manufactured, stored, transported, used, and sold in an orientation other than the position described.

Figure 1:
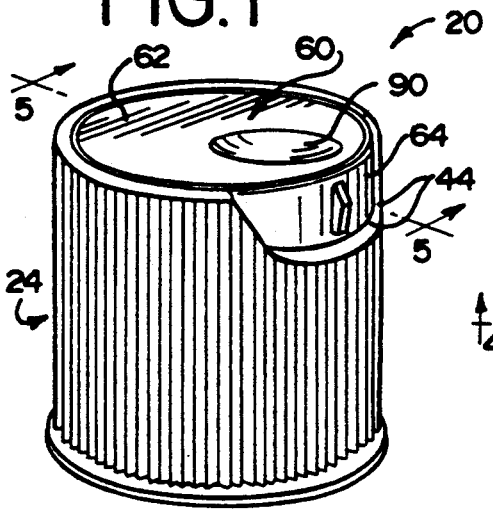
FIG. 1 is a perspective view of the closure of the present invention shown in a non-dispensing, closed orientation.

FIG. 1 shows an embodiment of the dispensing closure of the present invention in the closed, non-dispensing position wherein the closure is represented generally by reference numeral 20. The closure 20 is adapted to be mounted on a container (not illustrated) which may have a conventional open mouth defined by a neck (not illustrated) or other suitable structure. The container most typically is of the type having a generally flexible wall portion which can be squeezed to assist in dispensing the contents from the container.

The closure 20 includes a closure base or body 24 (FIGS. 3 and 4) for securement to the container. As seen in FIG. 4, the body 24 includes a generally cylindrical, upper wall 26 and a generally cylindrical, lower wall 27. A generally transverse closure wall or deck 28 (FIGS. 3, 4, 8, and 9) extends across the body 24 between the upper wall 26 and lower wall 27.

Figure 8:
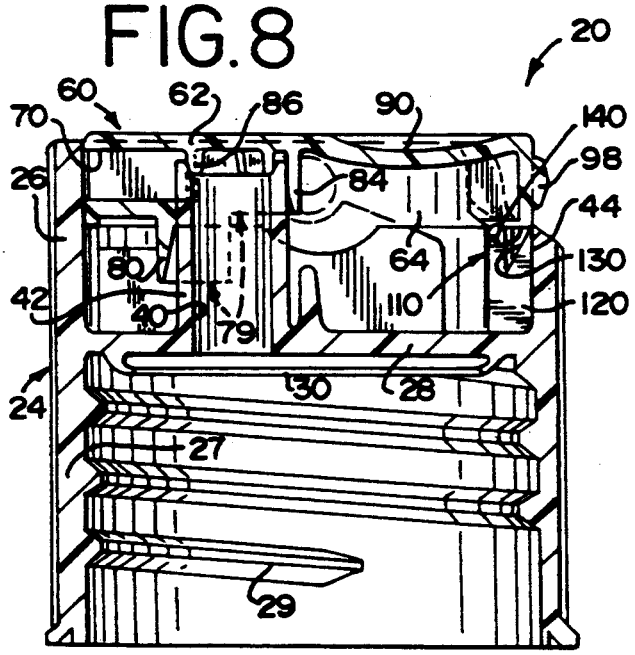
FIG. 8 is an enlarged, cross-sectional view taken generally along the plan 5—5 in FIG. 1.

The lower, cylindrical wall 27 of the closure body 24 is adapted to engage the outer periphery of the top of the container neck (not illustrated) around the container mouth, as with threads 29 (FIGS. 4 and 8). Other suitable engaging means (e.g., snap-fit beads) may be provided to secure the closure body 24 on the container. Alternatively, in some applications the closure body 24 could be non-releasably attached to, or formed unitary with, the container.

Figure 9:
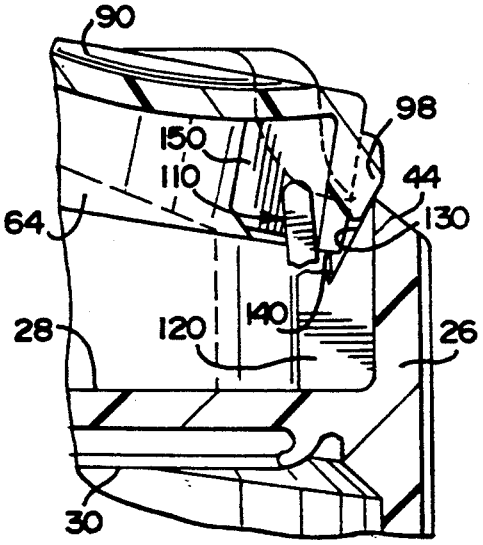
FIG. 9 is a fragmentary, view similar to FIG. 8 showing the actuator moved to a position intermediate the full closed and full open positions.

An annular sealing ring 30 may be provided as shown in FIGS. 4, 8, and 9 for engaging an interior edge of the container neck at the container mouth to effect a tight seal.

Figure 3:
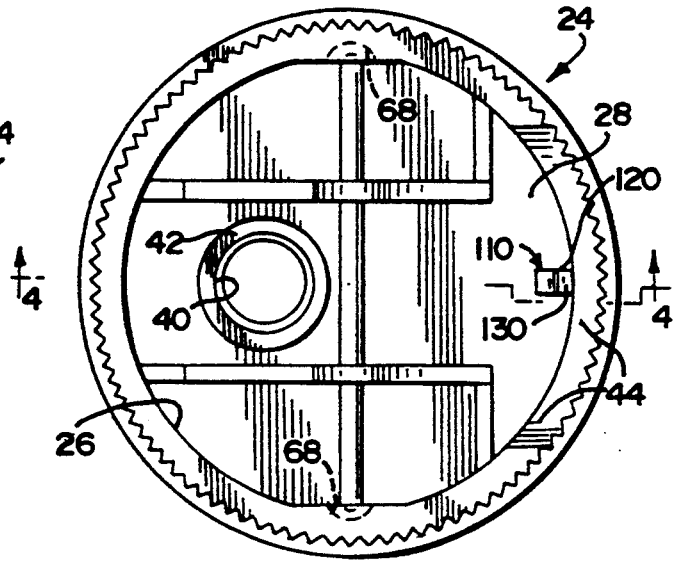
FIG. 3 is an enlarged, plan view of the closure with the actuator removed to reveal interior details of the body.
Figure 4:
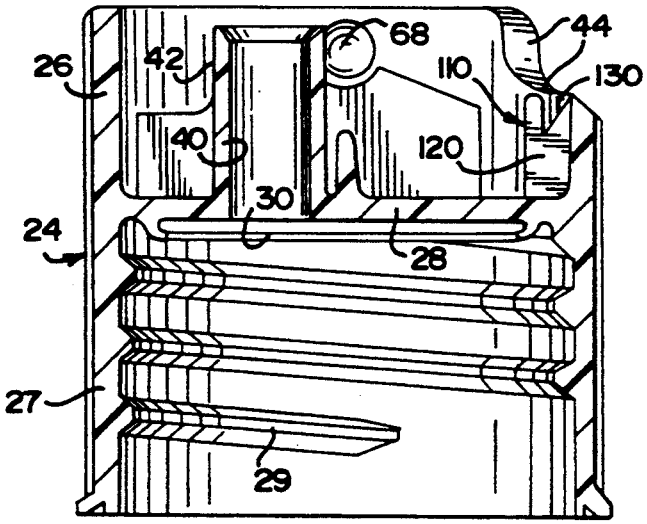
FIG. 4 is a greatly enlarged, cross-sectional view taken generally along the plane 4—4 in FIG. 3.

The closure body 24 includes a discharge aperture or passage 40 through the deck 28 as best illustrated in FIGS. 3, 4, and 8. In the preferred embodiment, the closure body 24 includes a discharge tube 42 projecting upwardly from the deck 28, and the discharge aperture 40 is defined within, and through, the tube 42. The discharge aperture 40 in the tube 42 communicates through the deck 28 with the container interior at the lower end of the tube 42.

As shown in FIGS. 3, 4, 8, and 9, the cylindrical, upper wall 26 of the closure body 24 extends upwardly above, and around, the closure body deck 28. A rear portion of the wall 26 above the deck 28 defines a fingerwell or finger recess area 44 in the form of a cutout or notch in the top edge of the wall 26.

Figure 5:
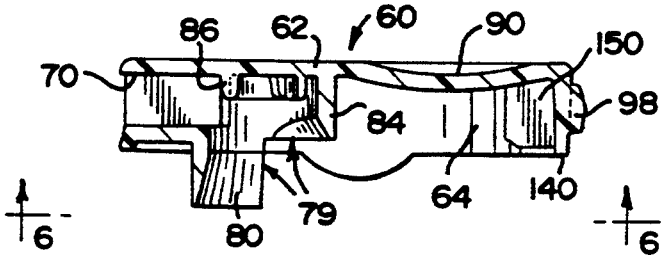
FIG. 5 is an enlarged, cross-sectional view of the actuator taken generally along the plane 5–5 in FIG. 1 with the body omitted for ease of illustration.
Figure 6:
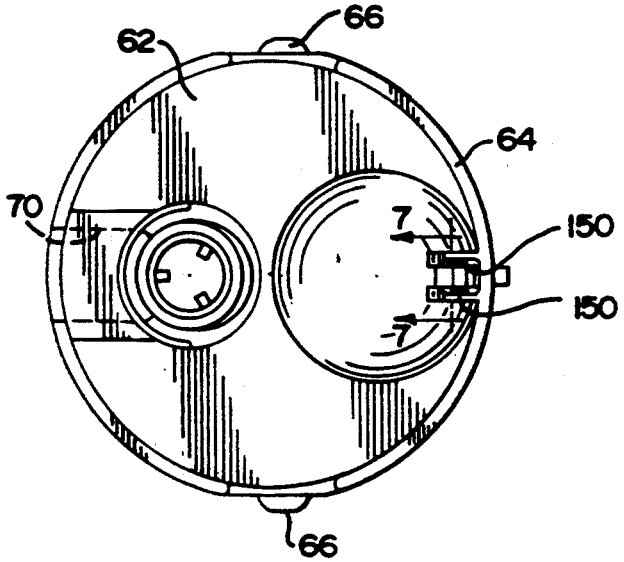
FIG. 6 is a bottom plan view of the actuator taken generally along the plane 6—6 in FIG. 5.

The closure body 24 receives a generally disc-like nozzle assembly, actuator means, or actuator 60. The actuator 60 includes a transverse top wall 62 and a peripheral flange 64 (FIGS. 1, 2, 5, 6, 8, and 9). At each of two diametrically opposed portions of the flange 64 there is a projecting, hemispherical protuberance or pivot member 66 with a flattened face (FIGS. 4, 6, and 8).

The pivot members 66 cooperate with the closure body upper wall 26 to mount the actuator 60 for pivoting movement within the closure body 24. To this end, the inner surface of the closure body wall 26 defines two hemispherical recesses 68 (FIGS. 3 and 4) for each mating with one of the pivot members 66 to provide a snap-action engagement of the pivot member 66. This accommodates the pivoting movement of the actuator 60 about a pivot axis defined by the pivot members 66 and receiving recesses 68.

Figure 2:
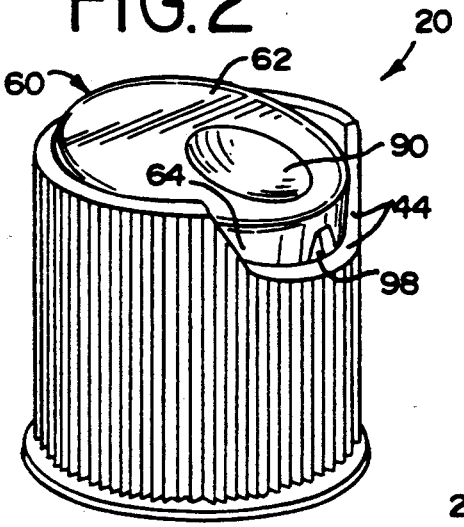
FIG. 2 is a perspective view of the closure shown in an open, dispensing orientation.

The top edge of the wall 26, above each recess 68, may be provided with a chamfer (not shown) for facilitating assembly. When the body 24 and actuator 60 are assembled, the actuator pivot members 66 and body recesses 68 function as mounting means so that the actuator 60 can be pivoted (by pushing downwardly on the rear portion of the actuator 60) until the forward end is exposed above the closure body wall 26 as illustrated in FIG. 2.

The actuator 60 includes a structure on the bottom surface of the top wall 62 which functions—depending upon the orientation of the actuator 60—to either permit dispensing of flowable material from the body discharge tube 42 or occlude the tube passage 40 so as to prevent flow out of the discharge tube 42. In particular, as shown in FIGS. 5, 6, and 8, the actuator 60 includes a forwardly extending nozzle or channel 70 which merges with, and opens into, a stepped, cylindrical sealing wall 79.

The wall 79 surrounds and seals the upper periphery of the discharge tube 42 when the actuator 60 is in the closed position as illustrated in FIG. S. In particular, the wall 79 forms a seal around the outer periphery of the discharge tube 42 as indicated by reference number 80 (FIGS. 5 and 8) at the front of the tube 42 and as indicated by the reference numeral 84 at the rear of the tube 42.

Preferably, a sealing plug 86 projects downwardly from the bottom of the actuator top wall 62. The sealing plug 86 has a generally cylindrical or annular configuration and is adapted to enter into the opening at the top of the discharge tube 42 to sealingly occlude the discharge aperture 40 in the tube 42 when the actuator is in the closed position as illustrated in FIG. 8.

On the other hand, when the rear of the actuator 60 is pushed down to tilt the actuator to the dispensing position as illustrated in FIG. 2, then the front portion of the sealing plug 86 is tilted away from the top of the discharge tube 42 to permit flow of the material out of the discharge aperture in the tube 42 and through the dispensing nozzle 70. When the actuator 60 is tilted to the dispensing position as illustrated in FIG. 2, the wall 79 (FIG. 5) still continues to seal the outer periphery of the upper end of the discharge tube 42 so that the container contents, while being dispensed into the nozzle 70, cannot leak out around the top of the discharge tube 42.

The actuator 60 can be pivoted to the open position by applying a downwardly directed force at a location on the top of the actuator 60. To this end, a rear portion of the actuator top wall 62 is recessed within a concave surface or finger well 90 (FIGS. 1, 2, and 4) for receiving the end of a thumb or finger.

An angled cam 98 (FIGS. 5 and 9) projects rearwardly from the outer, vertical surface of the actuator flange 64 at the rear of the actuator 60. As illustrated in FIGS. 2, 3, 4, 8, and 9, the closure body cylindrical, upper wall 26 defines surface which is radially aligned with the cam 98 on the back of the actuator 60. When the actuator 60 is tilted to the dispensing position (FIG. 2), the most rearwardly extending portion of the cam 98 frictionally engages the wall 26. The cam 98 thus serves to stabilize the actuator 60 as it is being pivoted, and the cam 98 provides a frictional engagement to maintain the actuator in the tilted, open position. The actuator 60 can be returned to the closed position by pushing down on the front part of the actuator.

In accordance with the present invention, a permanently deformable and severable resistance means or abutment, such as post 110, is provided to prevent accidental movement of the actuator 60 to the open, dispensing orientation. This provides a closure which is resistant to inadvertent actuation during shipping and handling prior to use by a consumer.

The post 110 is located at the rear of the closure and projects upwardly from the body deck 28. The post 110 is included as part of an upstanding wall 120 and has oppositely facing planar sides. The abutment or post 110 is separated by a notch 130 from an adjacent portion of the wall 120.

The wall 120 lies under a shear wall 140 which is defined by the rear portion of the actuator peripheral flange 64. When a force is applied to the top, rear portion of the actuator 60, the shear wall 140 moves partway down into the notch 130 and then engages the abutment 110. The forces to which the actuator may be subjected during shipping and handling are typically insufficient to deform or shear the abutment 110. Thus, the actuator 60 cannot be tilted to any significant extent away from the closed, non-dispensing position. Further, the closure body wall 26 acts resiliently upon the angled surface of the actuator cam 98 to urge the cam 98 upwardly, and hence the actuator back to the closed, non-dispensing position.

However, when a consumer subsequently wishes to use the closure, the consumer initially applies a substantially greater force to the finger well 90. A force equal to, or greater than, a predetermined force will drive the shear wall 140 against the abutment 110 with a force sufficient to sever the abutment 110 from the wall 120. The sheared off abutment 110 does not fall onto the closure body deck 28, but rather is retained within the actuator by a novel retention structure.

Figure 7:
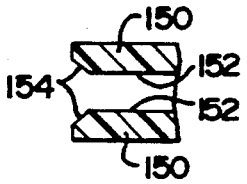
FIG. 7 is a greatly enlarged, fragmentary, partial, cross-sectional view taken generally along the plane 7—7 in FIG. 6.

Specifically, the rear portion of the actuator includes a pair of space-apart retaining walls 150 (FIGS. 6 and 7). Each wall defines a retaining surface 152 (FIG. 7 only) for sliding into engagement with the abutment 110 when the rear portion of the actuator 60 is tilted downwardly toward the closure body deck 28 (as shown in FIG. 9). The retaining walls 150 are spaced apart by an amount which is slightly less than the width of the abutment 110. The walls 150 are somewhat resilient so as to accommodate the movement of the walls down around the abutment 110.

The bottom portion or edge of each wall defines an angled surface 154 (FIG. 7). The angled surfaces 154 accommodate the initial movement of the walls 150 so that the abutment 110 is properly guided into, and received between, the walls 150. In a preferred embodiment, each surface 154 is angled at about 45 degrees relative to the adjacent vertical wall surface.

As the rear portion of the actuator 60 is tilted downwardly (FIG. 9), the retaining walls 150 deform as necessary to permit the continued reception of the abutment 110 deeper into the space between the walls 150. Eventually, the shearing wall 140 has moved an amount that is sufficient to completely sever (e.g., cut, break, tear, etc.) the abutment 110 completely from the wall 120. The sheared off abutment 110 remains tightly trapped between the spaced-apart walls 150 in the actuator 60. Thus, the sheared off abutment 110 cannot move or rattle around within the closure. As a result, there is no possibility that the sheared off abutment 110 can be inadvertently jostled into a position which might interfere with subsequent opening of the actuator.

The above-described retention structure, which includes the walls 150, can be readily molded in the closure actuator. Conventional molds can be relatively easily retrofitted to include this feature.

Once the abutment 110 has been sheared off and retained within the retaining walls 150, the actuator can be subsequently closed and then reopened as necessary. The subsequent reopening of the actuator requires considerably less force than is required to initially shear off the abutment 110. The force required for subsequent actuation need only be great enough to overcome the friction and interfering engagement between the actuator cam 98 and the body wall 26 (as well as any other snap fit interference features that may be employed to provide a small retention force on the actuator in the closed position).

The closure of the present invention can be readily molded from thermoplastic materials and easily assembled to provide a stream-lined product. The closure provides a desirable toggle-action dispensing operation. The closure includes an abutment for preventing, or reducing the likelihood of, an inadvertent, premature opening or actuation of the closure to the dispensing position during shipping and handling. Although the abutment can be subsequently sheared off by the consumer, a unique retention system is provided for automatically gripping the sheared off abutment to prevent it from rattling within the closure.

It will be readily apparent from the foregoing detailed description of the invention and from the illustrations thereof that numerous variations and modifications may be effected without departing from the true spirit and scope of the novel concepts or principles of this invention.

What is claimed is:

1. In a toggle-action dispensing closure for an opening to a container wherein said closure includes:

a body for engaging said container over said opening and defining a discharge aperture communicating with said opening; and an actuator pivotally mounted on said body for occluding flow from said container through said discharge aperture when said actuator means is in a closed non-dispensing position and for permitting flow from said container when force is applied to said actuator to tilt said actuator to an open dispensing position, said body having a severable abutment under said actuator, and said actuator having a shearing wall for confronting said abutment when said actuator is in said non-dispensing position to prevent tilting of said actuator to said dispensing position in response to said actuator being subjected to a force less than a predetermined force, but said shearing wall shearing said abutment from said body when said actuator is subjected to at least said predetermined force so that thereafter said actuator can be tilted to said dispensing position in response to the application of force less than said predetermined force, the improvement comprising:

a pair of spaced-apart retaining surfaces defined by said actuator for sliding into engagement with said abutment when said actuator is subjected to at least said predetermined force to tilt the actuator to the open dispensing position and shear off said abutment whereby by the sheared off abutment is gripped between said retaining surfaces.

2. The closure in accordance with claim 1 in which said actuator includes two spaced-apart walls each defining one of said retaining surfaces.

3. The closure in accordance with claim 1 in which said actuator includes an angled surface merging with one of said retaining surfaces to facilitate engagement of said one retaining surface with said abutment.

4. The closure in accordance with claim 1 in which said actuator includes two spaced-apart walls comprising a thermoplastic material, said walls being resilient and being spaced-apart by a distance less than the width of said abutment.

5. The closure in accordance with claim 1 in which each said wall includes an edge surface angled at about 45 degrees relative to said retaining surface.

6. The closure in accordance with claim 1 in which said actuator has a top wall and a depending peripheral flange; and said retaining surfaces extend from said top wall and said peripheral flange.

7. In a toggle-action dispensing closure for an opening to a container wherein said closure includes:

a body for engaging said container over said opening and defining a discharge aperture communicating with said opening; and an actuator pivotally mounted on said body for occluding flow from said container through said discharge aperture when said actuator is in a closed non-dispensing position and for permitting flow from said container when force is applied to said actuator to tilt said actuator to an open dispensing position, said body having a severable abutment under said actuator but disengaged from said actuator when said actuator is in said non-dispensing position, and said actuator having a shearing wall located adjacent the periphery of the actuator for confronting said abutment when said actuator is in said non-dispensing position to prevent tilting of said actuator to said dispensing position in response to said actuator being subjected to a force less than a predetermined force, but said shearing wall shearing said abutment from said body when said actuator is subjected to at least said predetermined force so that thereafter said actuator can be tilted to said dispensing position in response to the application of force less than said predetermined force, the improvement comprising:

a pair of spaced-apart depending walls extending below said actuator and defining a pair of spaced-apart retaining surfaces for sliding into engagement with said abutment when said actuator is subjected to at least said predetermined force to tilt the actuator to the open dispensing position and shear off said abutment whereby by the sheared off abutment is gripped between said retaining surfaces.

8. The closure in accordance with claim 7 in which said actuator depending walls each include an angled surface merging with one of said retaining surfaces to facilitate engagement of said one retaining surface with said abutment.

9. The closure in accordance with claim 7 in which said actuator depending walls comprise a thermoplastic material, said walls being resilient and being spaced-apart by a distance less than the width of said abutment.

10. The closure in accordance with claim 7 in which each said depending wall includes an edge surface angled at about 45 degrees relative to said retaining surface.

11. The closure in accordance with claim 7 in which said actuator has a top wall and a depending peripheral flange; and each said depending wall extends from said top wall and said peripheral flange.

12. The closure in accordance with claim 7 in which said abutment has generally planar sides for being engaged by said depending walls.

* * * * *